US007841327B2

(12) United States Patent
Sopinsky et al.

(10) Patent No.: US 7,841,327 B2
(45) Date of Patent: Nov. 30, 2010

(54) TOY PROJECTILE LAUNCHER

(75) Inventors: Brandon C. Sopinsky, Redondo Beach, CA (US); Binh Luong, San Gabriel, CA (US); Steed Sun, San Gabriel, CA (US); Peter Fan, Torrance, CA (US); Henry Miller, Alta Loma, CA (US)

(73) Assignee: Mattel, Inc., El Segundo, CA (US)

( * ) Notice: Subject to any disclaimer, the term of this patent is extended or adjusted under 35 U.S.C. 154(b) by 513 days.

(21) Appl. No.: 11/856,041

(22) Filed: Sep. 15, 2007

(65) Prior Publication Data

US 2009/0071455 A1 Mar. 19, 2009

(51) Int. Cl.
*F41B 7/08* (2006.01)

(52) U.S. Cl. ..... 124/16; 124/82

(58) Field of Classification Search ..... 124/16, 124/26, 27, 28, 29, 41.1, 45, 51.1, 82
See application file for complete search history.

(56) References Cited

U.S. PATENT DOCUMENTS 2,960,790 A 11/1960 Pullen
3,018,578 A 1/1962 Hill
3,026,642 A 3/1962 Ryan
3,035,564 A 5/1962 Hellman
3,369,535 A * 2/1968 Bonanno ..... 124/29
4,260,087 A 4/1981 Leaver
4,450,992 A 5/1984 Casull
4,613,068 A * 9/1986 Bianchi ..... 224/242
4,768,681 A 9/1988 Dean et al.
5,660,159 A 8/1997 Clayton
5,711,285 A 1/1998 Stewart et al.
5,738,256 A * 4/1998 Goff et al. ..... 224/185
5,782,025 A 7/1998 Yoder
D412,243 S * 7/1999 Shkreli ..... D3/224
RE37,616 E 4/2002 Schumacher
6,695,676 B2 2/2004 Blake

* cited by examiner

*Primary Examiner*—John Ricci
(74) *Attorney, Agent, or Firm*—The Mueller Law Office, P.C.

(57) ABSTRACT

The present invention is a toy projectile launcher in the form of a role play accessory such as a belt. The belt assembly includes a strap, a launcher housing, and projectiles stored on the belt strap. The belt strap feeds through the launcher housing so that projectiles may be launched from the strap. In one embodiment the launcher is hand-held, and includes a handle which serves both for holding the launcher during operation and as a power switch for the launcher. Projectiles may be discharged singly from the launcher or continuously in a rapid-fire mode.

20 Claims, 2 Drawing Sheets

TOY PROJECTILE LAUNCHER

BACKGROUND OF THE INVENTION

Toy projectile launchers have been designed in many configurations over the years to provide interesting and new forms of amusement. Launchers have appeared as hand-held weapons, wrist-mounted components, waist-mounted units, and shoulder-supported cannons. Projectiles have been shaped as darts, spheres, and disks, and have been modified to include features such as sound effects and lighting. An element of surprise has been incorporated into some projectile launchers by disguising them within decorative belt buckles or in holsters. These disguised launchers are typically are operable either by detaching them from their associated accessory, such as a belt, or by using them while they remain attached to an accessory. Such a variety in projectile launchers enhances creativity and often spurs new play aspects for the user.

Thus, while toy projectile launchers have been popular for many years, there is a continuing need for new and unique ways of launching projectiles in order to provide enhanced amusement and recreational play for children and adults alike.

SUMMARY OF THE INVENTION

The present invention is a toy projectile launcher in the form of clothing or a role play accessory such as a belt worn around the waist. The belt may be removed from being worn as a piece of apparel so that it may be operated as a projectile launcher during play. The invention disclosed herein utilizes multiple components of a belt assembly, including a belt strap, to comprise the launcher. The belt strap stores a supply of projectiles and feeds them through the launcher. Projectiles may be launched either singly or in a continuous rapid-fire mode. Such a launcher may allow the user to engage in creative play to emulate, for example, secret agents, military personnel, movie characters, or superheroes.

In one embodiment the launcher is hand-held and includes a handle which functions both as a means for holding the launcher during operation, as well as a power switch for the launcher. In another embodiment, the launcher is mounted to a wrist and is configured for one-handed operation.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Figure 1:
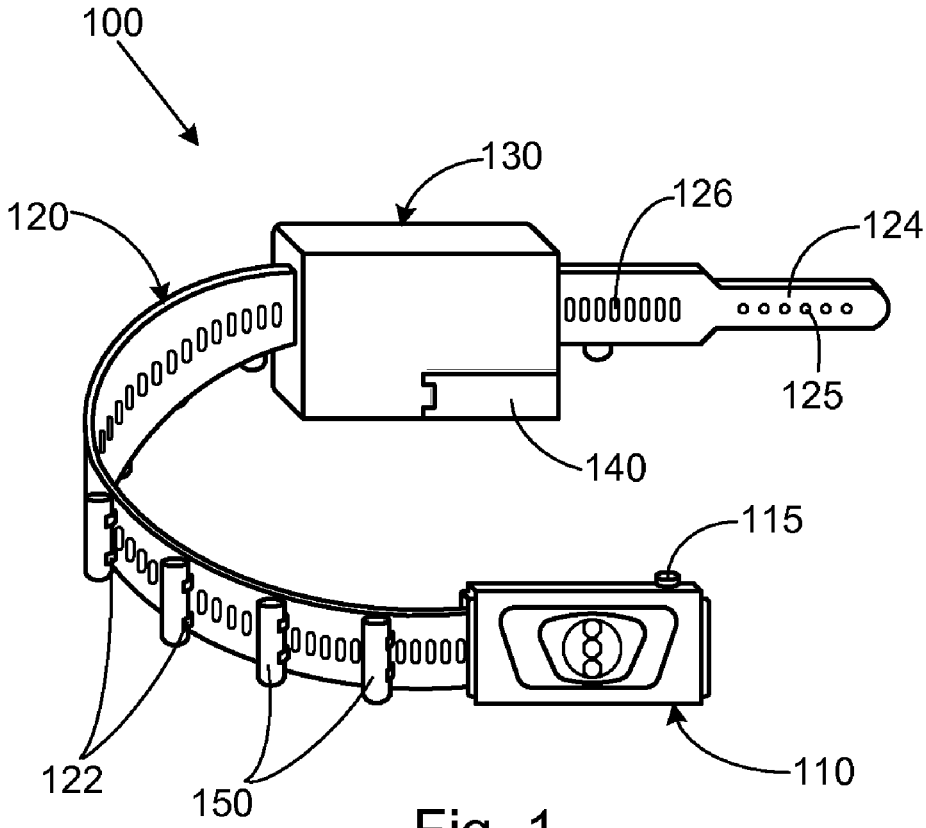
FIG. 1 provides a perspective view of an embodiment of the toy belt projectile launcher.

FIG. 1 illustrates an exemplary perspective view of a toy projectile launcher 100 comprising a buckle 110, a strap 120, and a housing 130. Buckle 110 is located at one end of strap 120, and includes a release button 115. Housing 130 is slidably coupled to strap 120 and may be positioned anywhere along strap 120. For back while the launcher 100 is being worn as a piece of apparel. A handle 140 is incorporated into the back of housing 130, as will be described in more detail later. A plurality of projectiles 150 are coupled to strap 120 with a plurality of brackets 122 located along the length of strap 120. Strap 120 also includes a strap end 124, a series of fastening holes 125 within strap end 124, and a plurality of slots 126 along the length of strap 120. To wear the toy projectile launcher 100, the user wraps the strap 120 around the user's body, typically the waist, and inserts strap end 124 into buckle 110. Strap end 124 may be coupled to buckle 110 using means known in the art, such as a spring-loaded tab inside buckle 110 to engage with fastening holes 125. The toy projectile launcher 100 may be worn in an alternative fashion on the user, such as being strapped over one shoulder and hung diagonally across the torso.

In order to unfasten strap end 124 from buckle 110, the user depresses release button 115 on buckle 110. Note that FIG. 1 represents only one embodiment of the release button 115, as release button 115 may be located elsewhere on buckle 110 and may take other forms such as a hinged latch or a sliding lock. Alternatively, strap end 124 and buckle 110 may incorporate other conventional fasteners, such as a hook protruding on the exterior of buckle 110 to be inserted into fastening holes 125, hook-and-loop fasteners on strap end 124 and on buckle 110, or mating clasp components on strap end 124 and on buckle 110. In such instances, the presence of release button 115 may not be required.

The components of launcher 100 may be manufactured from suitable plastics known in the art, such as polypropylene (PP) for strap 120, acrylonitrile butadiene styrene (ABS) for buckle 110 and housing 130, and foam for projectiles 150 with optional rubber tips.

Figure 2:
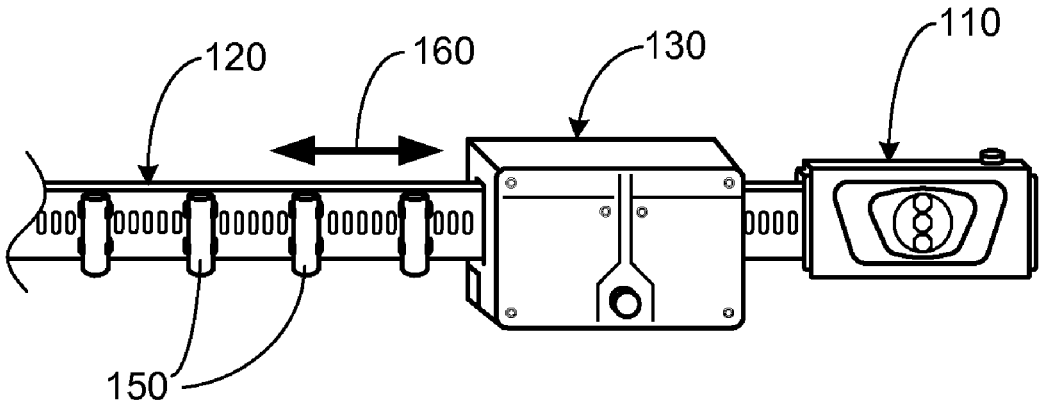
FIG. 2 shows a front perspective view of an embodiment of the invention preparing for launching.

FIG. 2 depicts the invention being prepared for use as projectile launcher. Housing 130 is manually moved, as indicated by arrow 160, along the length of strap 120 to a position near or over the desired projectile 150 to be launched. A typical starting position for housing 130 is substantially adjacent to buckle 110 so that the entire plurality of projectiles 150 is available for feeding through housing 130.

Figure 3:
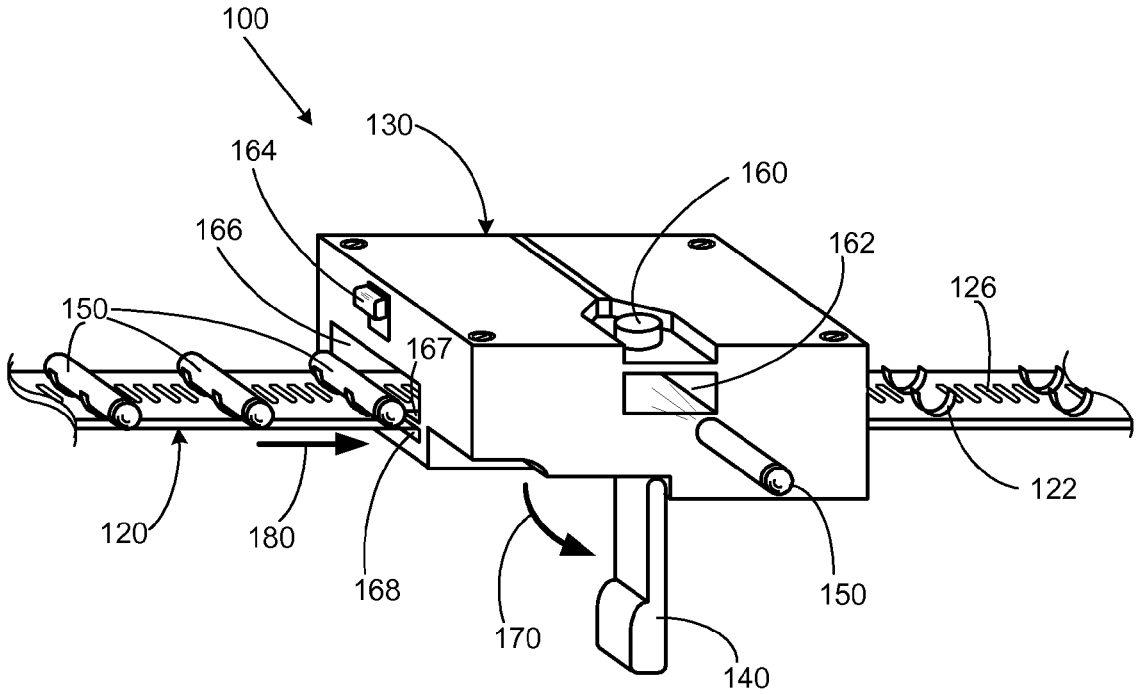
FIG. 3 illustrates a perspective view of a projectile being launched.

Turning to FIG. 3, an embodiment is shown of the launcher 100 discharging a projectile 150. In this view, additional elements of housing 130 are seen, including a trigger button 160, a launch port 162, a release button 164, and an opening 166 with an internal lip 167 and a groove 168. It can be seen that during operation, launcher 100 is turned horizontally for launching projectiles 150 out of launch port 162. In this embodiment, lip 167 forms groove 168 at the bottom of opening 166. Groove 168 maintains strap 120 in its position to feed through opening 166 of housing 130. Instead of being a protrusion formed from the wall of opening 166, lip 167 may be replaced by, for example, spring tabs extending from the wall of opening 166.

Within housing 130, an internal motorized drive, not shown, advances strap 120 through housing 130 during launcher operation. A standard power supply such as a battery pack may be used to energize the internal motorized drive and any other parts requiring power in launcher 100. The internal motorized drive may incorporate conventional components such as gears mating with slots 126, or such as a roller drive which utilizes friction to move strap 120. Optional release button 164 above opening 166 disengages any internal motorized drive components from strap 120 so that strap 120 may be completely removed from housing 130 if desired.

Still referring to FIG. 3, handle 140 is pivoted downwardly from housing 130, as represented by arrow 170, to allow the user to hold the launcher 100 during firing. Pivoting of handle 140 from a folded position against housing 130 to an open position as shown is achieved by means such as a hinge joint, a pin joint, or other means known in the art. A latch or locking means, not shown, may be incorporated into handle 140 to secure handle 140 it in its open position. In one embodiment, handle 140 also serves as a power switch for the launcher 100 for safety purposes. In such a configuration, handle 140 is coupled to a power supply, not shown, inside housing 130 so that the act of moving handle 140 from its folded position to its open position causes the power supply to turn on. Conversely, pivoting handle 140 from its open position back to its folded position against housing 130 causes the power supply for launcher 100 to turn off. Thus, when launcher 100 is being worn as a belt with handle 140 in its closed position, the launcher 100 is prevented from being able to launch projectiles 150 or from driving strap 120 through housing 130. Alternatively, the power supply for launcher 100 may be controlled by a separate manual switch on housing 130 rather than by being controlled by handle 140.

To shoot projectiles 150 from housing 130, the user depresses trigger button 160 on top of housing 130 in FIG. 3. Trigger button 160 activates the aforementioned motorized drive system so that belt strap 120 feeds through housing 130. As the belt strap 120 feeds through housing 130, projectiles 150 encounter a launching system, not shown, incorporating means known in the art for launching projectiles. In one such embodiment, a launching system may utilize a pair of motorized flywheels to lift projectiles 150 out of brackets 122 and propel them out of launch port 162. In another embodiment, a spring-loaded piston may strike the projectiles 150, thus launching projectiles 150 out of housing 130 through launch port 162. Pressing the trigger button 160 a single time activates the motorized drive system and the launching system just long enough for a single projectile 150 to be released. Pressing trigger button 160 and continuing to hold it down results in an automatic feed mode, in which multiple projectiles 150 are sequentially discharged from housing 130 as belt strap 120 is driven through housing 130, shown directionally by arrow 180. In this rapid-fire mode, projectiles 150 shoot continuously, similar to a Gatling gun, until trigger button 160 is released. As can be seen in FIG. 3, the strap 120 with empty projectile holding brackets 122 exits the opposite end of housing 130 after projectiles 150 have been launched.

Figure 4:
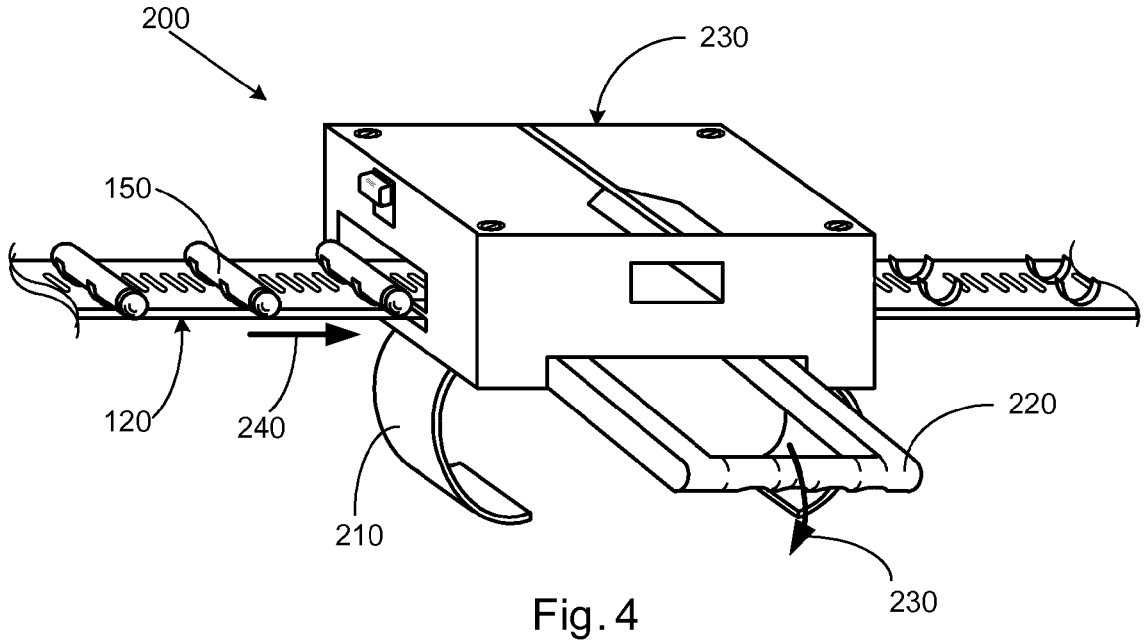
FIG. 4 is a perspective view of an alternative embodiment of a projectile launcher.

FIG. 4 illustrates an alternate configuration in which one-handed operation of the toy projectile launcher is possible. In this embodiment, a launcher 200 is mounted on a user's wrist with a cuff 210, rather than being hand-held as in FIG. 3. Cuffs 210 may be fabricated from, for example, stiff preformed plastic, or fabric bands which may be wrapped and secured around the user's wrist. A trigger bar 220 is grasped by the same hand on which the launcher is mounted. To launch projectiles 150, the user bends his wrist to pivot trigger bar 220 downward as shown by arrow 230. A single flick of the wrist results in a single projectile 150 being launched, whereas holding down trigger bar 220 results a rapid-fire mode. The rapid-fire mode results in belt strap 120 being continuously fed through housing 230 as directionally indicated by arrow 240, and projectiles 150 being sequentially launched.

In further use of this invention, additional play components may be coupled to launcher 100 or launcher 200 so that the toy also functions as a utility belt. For example, walkie-talkies, ammunition storage packs, or additional toy weapons (grenades, boomerangs, daggers) may be coupled to belt strap 120 or to housing 130 with hooks, clips, ties, detents, or the like. Moreover, sound or light effects, such as flashing lights or machine gun sounds, may be synchronized with launching of projectiles to increase the amusement value of the device.

Although embodiments of the invention have been discussed primarily with respect to specific embodiments thereof, other variations are possible. In one option, housing 130 and buckle 110 may be combined into a single unit such that the strap end 124 attaches directly into housing 130. In another variation, shapes other than a rectangular-shaped housing 130 may be desirable for functional, aesthetic, or ergonomic reasons. For example, housing 130 may take the shape of a fanny pack to disguise the device, or may take the shape of a character logo.

It may be possible to use trigger devices other than the trigger button 160 or trigger bar 220 included in this disclosure. For example, a pull-chain, a traditional pistol-type trigger, a rotating knob, a slide switch, or other mechanism may be used. A pistol-type trigger may be incorporated into handle 140 rather than having a trigger on housing 130. Likewise, a wrist attachment component may incorporate a trigger device such as a pull-chain such that bending of the wrist activates the pull-chain trigger.

Other methods for holding the launcher, in addition to the hand-held or wrist-mounted options previously described, are possible. As an example, the pivotable handle 140 may take the form of folding legs which allow the launcher to sit on a tabletop when unfolded. Alternatively, the launcher may be configured to be shoulder-mounted.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A toy projectile launcher, comprising:

a belt;

a projectile coupled to said belt; and a housing movably coupled to said belt, wherein said housing comprises:

a launching system for feeding said belt through said housing and for launching said projectile from said housing; and a handle, wherein said handle is movable from a retracted position to an operative position, wherein said retracted position turns off said launching system, and wherein said operative position turns on said launching system.

2. The toy projectile launcher of claim 1, wherein said belt is of sufficient length to be worn around the waist of a user.

3. The toy projectile launcher of claim 1, wherein said projectile is a foam dart.

4. The toy projectile launcher of claim 1, wherein a plurality of projectiles are coupled to said belt.

5. The toy projectile launcher of claim 4, wherein said launching system is capable of continuously launching said plurality of projectiles.

6. The toy projectile launcher of claim 1, wherein said launching is triggered by a push button located on said housing.

7. The toy projectile launcher of claim 1, further comprising a belt buckle attached to a first end of said belt.

8. A toy projectile launcher, comprising:

a belt;

a projectile coupled to said belt; and a housing movably coupled to said belt, wherein said housing comprises:

a launching system for feeding said belt through said housing and for launching said projectile from said housing; and a wrist attachment component.

9. The toy projectile launcher of claim 8, wherein said launching is triggered by wrist movement associated with said wrist attachment component.

10. The toy projectile launcher of claim 8, wherein said belt is of sufficient length to be worn around the waist of a user.

11. The toy projectile launcher of claim 8, wherein said launching system is capable of continuously launching a plurality of projectiles.

12. The toy projectile launcher of claim 8, further comprising a belt buckle attached to a first end of said belt.

13. A toy projectile launcher, comprising:

a belt;

a projectile coupled to said belt; and a housing movably coupled to said belt, wherein said housing comprises:

a launching system for feeding said belt through said housing and for launching said projectile from said housing; and a belt buckle.

14. The toy projectile launcher of claim 13, wherein said belt is of sufficient length to be worn around the waist of a user.

15. The toy projectile launcher of claim 13, wherein said housing further comprises a handle movable from a retracted position to an operative position, wherein said retracted position turns off said launching system, and wherein said operative position turns on said launching system.

16. The toy projectile launcher of claim 13, wherein said launching system is capable of continuously launching a plurality of projectiles.

17. A method of launching projectiles, said projectiles coupled to a belt, wherein a projectile launcher is coupled to said belt, comprising:

wearing said belt on a waist;

removing said belt from said waist;

positioning said projectile launcher at a desired location for said launching;

engaging said projectile launcher in a mode supporting said launching;

launching said projectile from said projectile launcher; and disengaging said mode supporting said launching;

wherein said engaging and disengaging is controlled by a movable handle coupled to said projectile launcher.

18. The method of launching projectiles of claim 17, wherein said positioning comprises sliding said projectile launcher along the length of said belt.

19. The method of launching projectiles of claim 17, wherein said projectile comprises a foam dart.

20. The method of launching projectiles of claim 17, wherein said launching comprises continuously launching a plurality of said projectiles.

* * * * *